US012649597B2

(12) United States Patent
Gupta et al.

(10) Patent No.: US 12,649,597 B2
(45) Date of Patent: Jun. 9, 2026

(54) SEALING HEAD AND RELATED METHOD

(71) Applicant: Northern Lights Research Inc., Etobicoke (CA)

(72) Inventors: Sahil Gupta, Brampton (CA); Anand Prafulchandra Kantesaria, Etobicoke (CA); Sirinkumar Patel, Brampton (CA)

(73) Assignee: Northern Lights Research Inc., Etobicoke (CA)

( * ) Notice: Subject to any disclaimer, the term of this patent is extended or adjusted under 35 U.S.C. 154(b) by 25 days.

(21) Appl. No.: 18/394,322

(22) Filed: Dec. 22, 2023

(65) Prior Publication Data

US 2024/0208682 A1 Jun. 27, 2024

Related U.S. Application Data

(60) Provisional application No. 63/477,144, filed on Dec. 23, 2022.

(51) Int. Cl.

| | |
|---|---|
| ***B65B 7/28*** | (2006.01) |
| ***B65B 51/00*** | (2006.01) |
| ***B65B 61/28*** | (2006.01) |

(52) U.S. Cl.

CPC ..... *B65B 7/2842* (2013.01); *B65B 51/00* (2013.01); *B65B 61/28* (2013.01)

(58) Field of Classification Search

None

See application file for complete search history.

(56) References Cited

U.S. PATENT DOCUMENTS

| | | | | |
|---|---|---|---|---|
| 2,859,575 | A * | 11/1958 | Lehmann | B65B 7/2878 264/296 |
| 4,838,008 | A * | 6/1989 | Hardy | B65B 7/2878 53/425 |
| 2022/0063849 | A1* | 3/2022 | Hatje | B65B 31/046 |
| 2022/0063855 | A1* | 3/2022 | Hatje | B65B 7/2878 |

* cited by examiner

*Primary Examiner* — Tanzim Imam

(74) *Attorney, Agent, or Firm* — Faegre Drinker Biddle & Reath LLP

(57) ABSTRACT

A sealing head for use in manufacturing a single-use pod, the sealing head comprising: a sealing assembly for securing a lid to a body of the pod, the sealing assembly having a sealing surface for pressing against the lid; and a ram assembly for separating the pod from the sealing assembly, the ram being at least partially movable relative to the sealing surface between a retracted position and an extended position, wherein in the retracted position a pressing face of the ram assembly is aligned with or recessed from the sealing surface, and in the extended position the pressing face extends beyond the sealing surface to contact the pod and separate the pod from the sealing assembly.

17 Claims, 10 Drawing Sheets

SEALING HEAD AND RELATED METHOD

CROSS-REFERENCE TO RELATED APPLICATIONS

The present application claims the benefit of and priority to U.S. Provisional Application Ser. No. 63/477,144, filed on Dec. 23, 2022, entitled SEALING HEAD AND RELATED METHOD, which is hereby incorporated by reference in its entirety for all purposes.

TECHNICAL FIELD

The present disclosure generally relates to equipment and methods for manufacturing single-use pods, and more particularly to sealing heads for use in manufacturing such pods and methods related to the same.

BACKGROUND

Single-use pods, also called capsules or containers, are commonly used in compatible brewing machines to produce beverages or the like. These pods and brewing machines have become ubiquitous in homes and offices to produce on demand beverages, such as coffee or tea. The convenience and quality of beverages produced by single-use pods has contributed to their rise in popularity, but concerns about waste may have tempered their overall use.

To alleviate concerns about waste, efforts have been made to develop and produce single-use pods that are more environmentally friendly, such as composable single-use pods. However, these environmentally friendly alternatives generally require alternative materials, which may complicate manufacturing of single-use pods.

Accordingly, alternatives and developments in the field of manufacturing single-use pods are generally desired, such as alternative methods and equipment for sealing a lid to a body of a single-use pod during manufacturing thereof.

SUMMARY

The following summary is provided to introduce a selection of concepts, which are further described below in the detailed description of embodiments. The aspects and embodiments set out in this summary are meant to be exemplary and illustrative, not limiting in scope. Nothing in this summary is intended to limit the scope of the claimed subject-matter. As will be appreciated, the terms "aspect" and "embodiment" are used interchangeably herein.

In an aspect of the present disclosure, there is provided sealing head for use in manufacturing a single-use pod, the sealing head comprising: a sealing assembly for securing a lid to a body of the pod, the sealing assembly having a sealing surface for pressing against the lid; and a ram assembly for separating the pod from the sealing assembly, the ram being at least partially movable relative to the sealing surface between a retracted position and an extended position, wherein in the retracted position a pressing face of the ram assembly is aligned with or recessed from the sealing surface, and in the extended position the pressing face extends beyond the sealing surface to contact the pod and separate the pod from the sealing assembly.

In one or more embodiments, the ram assembly may comprise a movable portion and a mounting portion, wherein the movable portion includes the pressing face and is movable relative to the sealing surface between the retracted position and the extended position, and wherein the mounting portion couples the movable portion to the sealing assembly. The movable portion may comprise a ram head and a ram rod, wherein the ram head includes the pressing face, and wherein the ram rod extends from the ram head opposite the pressing face and connects the ram head to the mounting portion. The ram rod may extend though an internal passageway of the sealing assembly. The ram head may be positioned within the internal passageway when the movable portion is in the retracted position, wherein the ram head extends at least partially out of the internal passageway when the movable portion is in the extended position. The ram head may be positioned within an enlarged recess of the internal passageway when the movable portion is in the retracted position. The movable portion of the ram assembly may be biased toward the retracted position and may be selectively movable from the retracted position to the extended position. The mounting portion may comprise an actuator that is coupled to the movable portion, and the actuator may be selectively engageable to move the movable portion from the retracted position to the extended position. The actuator may be pneumatically powered. The mounting portion may comprise a mounting plate for securing the actuator to the sealing assembly.

In one or more embodiments, the sealing assembly may comprise: a sealing element that includes the sealing surface; a slide rod that is coupled to and extends from the sealing element, opposite the sealing surface; a mounting collar that is movably retained on the slide rod and is configured to secure the sealing head to a pod manufacturing machine, the slide rod being slidable within the mounting collar to move the slide rod and the sealing element relative to the mounting collar; a damping spring secured between the mounting collar and the sealing element, the damping spring biasing the mounting collar away from the sealing element. The slide rod and the sealing element may define an internal passageway of the sealing assembly, and the ram assembly may extend though the internal passageway. The ram assembly may be coupled to the slide rod at an end of the slide rod that is opposite the sealing element In one or more embodiments, the pressing face may be circumferentially surrounded by the sealing assembly when the pressing face is aligned with or recessed from the sealing surface.

In one or more embodiments, the sealing surface may surround the pressing face when viewed from a sealing end of the sealing assembly.

In another aspect of the present disclosure, there is provided a pod manufacturing machine comprising a sealing head as described in the above paragraphs of the Summary.

In another aspect of the present disclosure, there is provided a method for use in manufacturing a single-use pod, the method comprising: pressing a sealing surface of a sealing assembly against a lid of the pod to secure the lid to a body of the pod; moving at least a portion of a ram assembly relative to the sealing surface from a retracted position to an extended position, wherein in the retracted position a pressing face of the ram assembly is aligned with or recessed from the sealing surface, and in the extended position the pressing face extends beyond the sealing surface; and contacting the lid of the pod with the pressing face as the portion of the ram assembly moves from the retracted position to the extended position to push the pod away from the sealing surface and separate the pod from the sealing assembly.

In one or more embodiments, the method may further comprise retracting the portion of the ram assembly from the extended position to the retracted position, after the pod has been separated from the sealing element.

In one or more embodiments, pressing the sealing surface against the lid of the pod may comprise advancing a sealing element of the sealing assembly toward the lid of the pod, and moving at least the portion of the ram assembly relative to the sealing surface may comprise at least one of: retreating the sealing element with respect to the pressing face of the ram assembly such that the pressing face extends beyond the sealing surface; and extending a movable portion of the ram assembly from a mounting portion of the ram assembly, the movable portion having the pressing face and the mounting portion being coupled to the sealing element.

In one or more embodiments, moving at least the portion of the ram assembly may comprise pneumatically actuating the ram assembly using compressed air from a pod manufacturing machine.

BRIEF DESCRIPTION OF THE DRAWINGS

Embodiments will now be described more fully with reference to the accompanying drawings, in which.

DETAILED DESCRIPTION OF EMBODIMENTS

Figure 1:
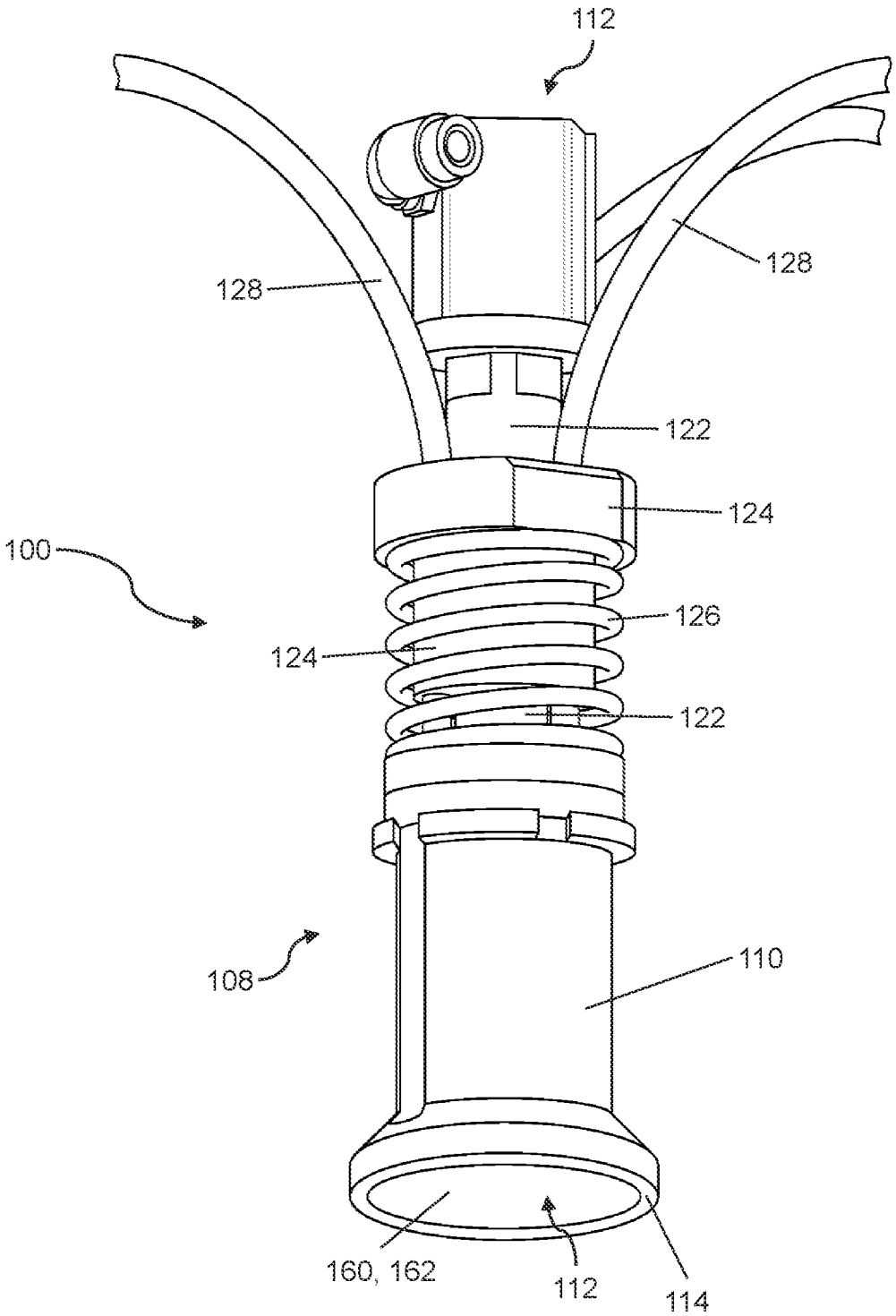
FIG. 1 is an isometric view of a sealing head in accordance with an embodiment of the present disclosure, taken from an angle to view the bottom of the sealing head.

This detailed description of embodiments, and the foregoing summary, will be better understood when interpreted in conjunction with the accompanying drawings.

As used herein, an element described in the singular and preceded by the word "a" or "an" should be understood as not necessarily excluding a plural of the elements. Further, references to "an example", "an embodiment", "one example", or "one embodiment" with a described element are not intended to be interpreted as excluding the existence of additional examples or embodiments with the described element. Moreover, unless explicitly stated to the contrary, examples or embodiments "comprising", "having", "with", or "including" an element having a particular property may further include additional elements not having that particular property. Additionally, references to "an example" or "an embodiment" throughout the subject discloser may, but do not necessarily, refer to the same example or embodiment.

As used herein, it will be understood that the terms "comprises", "has", "with", and "includes" all mean "including but not limited to" and the terms "comprising", "having", and "including" have equivalent meaning.

As used herein, the term "and/or" can include any and all combinations of one or more of the associated listed elements or features.

It will be understood that when an element is referred to as being "on", "attached", "connected", "coupled", or similarly engaged to another element, that element may be directly or indirectly on, attached, connected, or coupled to the other element. However, when an element is referred to as being "directly on", "directly attached", "directly connected", "directly coupled", "contacting", or similarly engaged to another element, there are no intermediate elements between that element and the other element. It will be similarly understood that when an element is referred to as being "proximally on", "proximally attached", "proximally connected", "proximally coupled", or similarly engaged to another element, those elements are engaged with a limited number of elements therebetween, such as a single element therebetween. It will be further understood that elements which are integrally formed may be referred to as being "on", "attached", "connected", "coupled" or similarly engaged (including the "directly" and "proximally" variants thereof). However, elements referred to as being "separably", "detachably", "selectively", "removably", or similarly coupled (and the variants thereof) are not integrally formed.

It will be understood that spatially relative terms, such as "under", "below", "lower", "over", "above", "upper", "front", "back", and the like, may be used herein for ease of describing the relationship of one element to another as depicted in the figures. However, elements described with spatially relative terms may encompass different orientations in use or operation, in addition to the orientation depicted in the figures and described herein.

Unless otherwise indicated, the terms "first", "second", etc. are used herein merely as labels, and are not intended to impose ordinal, positional, or hierarchical requirements on the items to which these terms refer. Moreover, reference to a "second" item does not require or preclude the existence of a lower-numbered item (e.g., a "first" item) and/or a higher-numbered item (e.g., a "third" item).

As used herein, references to an element being "configured" to perform a recited function does not include an element that is unintuitively capable of performing the recited function, such as an element that is intended for a different function but could be creatively adapted to perform the recited function.

As used herein, the terms "approximately" and "about" represent an amount close to the recited amount that still performs the desired function or achieves the desired result. For example, the terms "approximately" and "about" can refer to an amount that is within engineering tolerances that would be readily appreciated by a person of ordinary skill in the art.

Single-use pods, also known as capsules or containers, are commonly used with compatible brewing machines to produce beverages such as coffee, tea, or the like. These pods typically include a body, which forms a cavity that contains a brewing medium (such as coffee grounds), and a lid that is secured to the body and seals the cavity. During manufacturing of the pod, the lid is secured to the body by a sealing head. The sealing head generally applies heat and pressure to thermally fuse the lid to the body. Though, in some instances, the sealing head may secure the lid to the body of the pod by an adhesive, ultrasonic welding, and/or other suitable technique.

Occasionally, when the sealing head is extended into contact with the lid during manufacturing, the lid will become stuck to the sealing head and cause the pod to be raised out of a desired position as the sealing head is retracted. Compostable lidding material may be particularly prone to such sticking. Accordingly, to keep the pod in place during manufacturing, a vacuum may be used to retain the pod in the desired position. This vacuum may be increased near the sealing head.

However, applying a vacuum to the pod during manufacturing, such as near the sealing head, can cause the pod to deform, particularly for soft body pods that do not include a rigid body or shell to resist deformation by the vacuum. For example, in soft body pods, the vacuum may pass through the body of the pod (which is generally formed of a permeable filter material) and pull the lid inward, forming a concavity in the lid. This concavity may impede the pod from properly engaging with a brewing machine during use, which can negatively impact brew quality and, in some instances, may cause brewing to fail entirely. For example, the concavity may prevent a water injecting mechanisms of the brewing machine from puncturing the lid of the pod. Accordingly, reducing the vacuum that is applied to pods during manufacturing is generally desired. In particular, reducing the vacuum that is applied when the lid is sealed to the body of the pod during manufacturing may be desirable.

For at least the above reasons, alternative sealing heads and related methods for securing a lid to a body of a single-use pod during manufacturing are generally desired, and particularly alternatives and methods that may reduce the likelihood of a pod or its lid sticking to the sealing head during manufacturing without having to apply the use of a vacuum or air pressure on the pod.

Turning now to FIGS. 1 to 13, a sealing head in accordance with an embodiment of the present disclosure is shown and generally identified by reference character 100. The sealing head 100 is configured to be used during the manufacturing of a single-use pod 102, such as a single-use beverage pod or single-use coffee pod. More particularly, the sealing head 100 is configured to secure a lid 104 of the pod 102 to a body 106 of the pod 102 during manufacturing, and is further configured to remove the pod 102 from the sealing head once the lid 104 is secured. The sealing head 100 is configured to replace a conventional sealing head in a pod manufacturing machine. Pod manufacturing machines are well known in the art and will not be described herein for brevity.

Figure 14A:
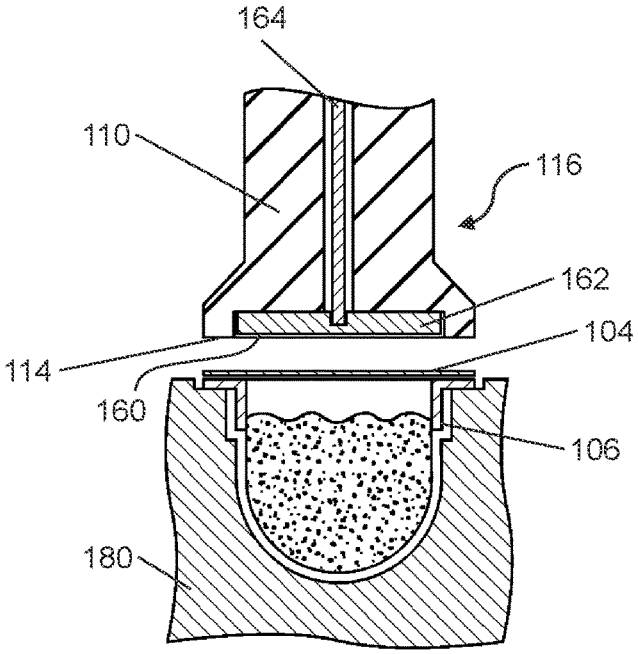
FIG. 14A to 14D are simplified sectional drawings showing a sequence for using the sealing head of FIG. 1.
Figure 14B:
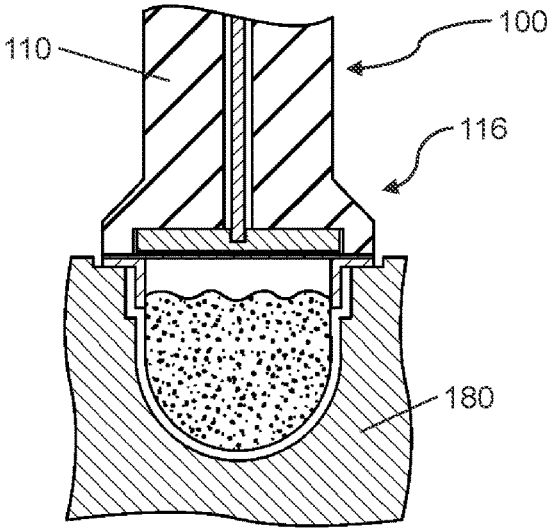
Figure 14C:
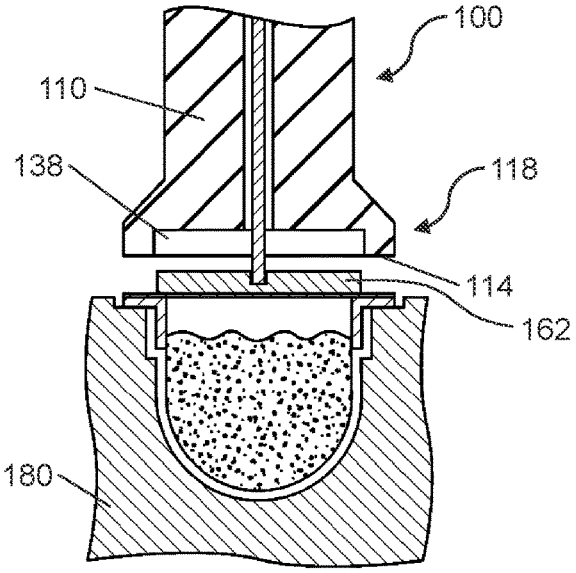

The sealing head 100 comprises a sealing assembly 108 and a ram assembly 112. The sealing assembly 108 is used to secure the lid 104 to the body 106 of the pod 102 during manufacturing. The ram assembly 112 is configured to separate the pod 102 from the sealing assembly 108. The sealing assembly 108 includes a sealing surface 114 for pressing against the lid 104. The ram assembly 112 is at least partially movable relative to the sealing surface 114 between a retracted position 116 and an extended position 118. In the retracted position 116 (shown in at least FIGS. 4 and 14A), a pressing face 160 of the ram assembly 112 is aligned with or recessed from the sealing surface 114 of the sealing assembly 108. In the extended position 118 (as shown in FIG. 14C), the pressing face 160 of the ram assembly 112 extends beyond the sealing surface 114 to contact the lid 104 of the pod 102 and separate the pod 102 from the sealing assembly 108.

Figure 4:
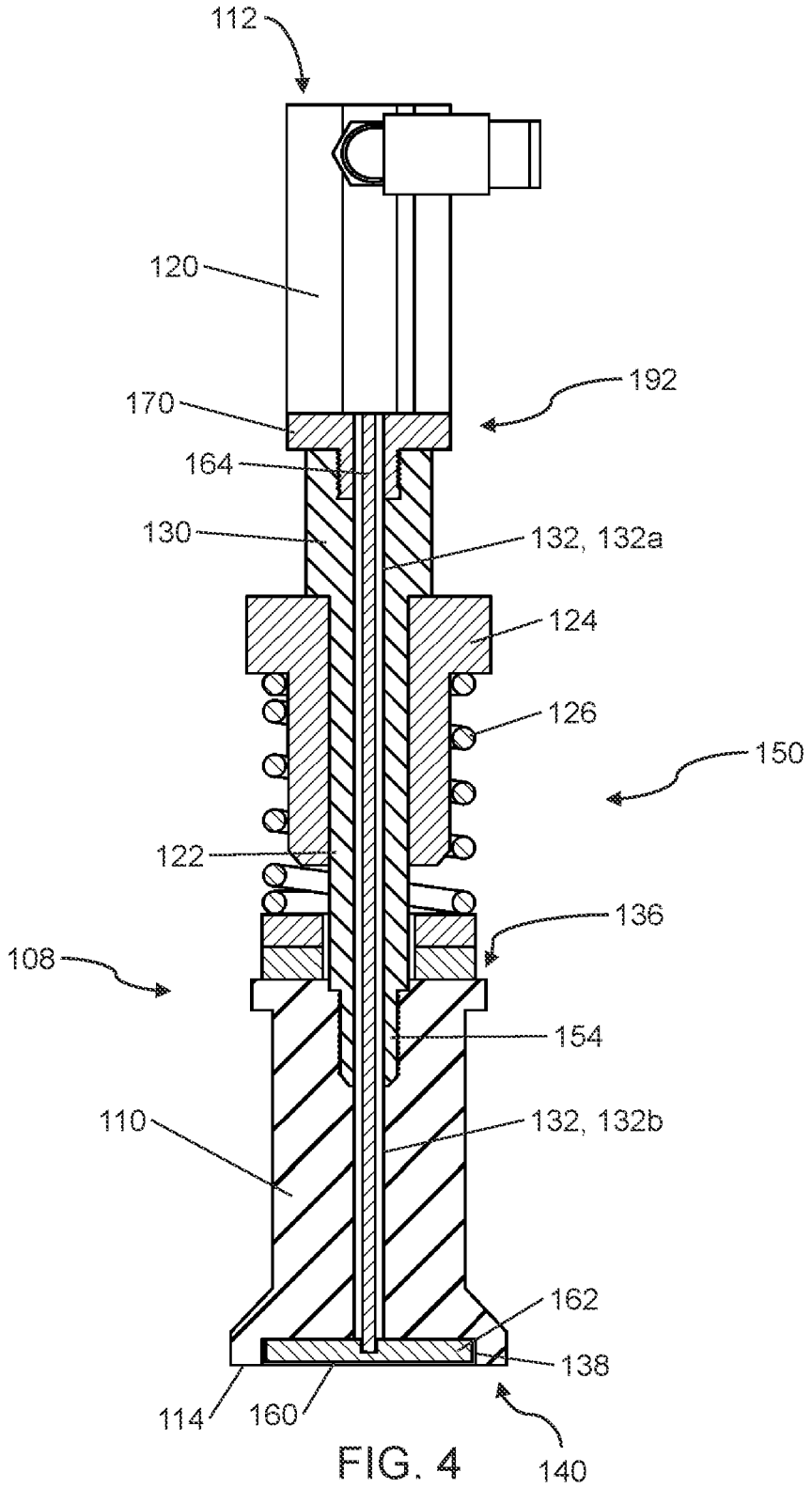
FIG. 4 is a partial cross-section view of the sealing head of FIG. 1, taken along line 4-4 shown in FIGS. 3 and 7, as will be appreciated an actuator of the sealing head is not shown in section view.
Figure 5:
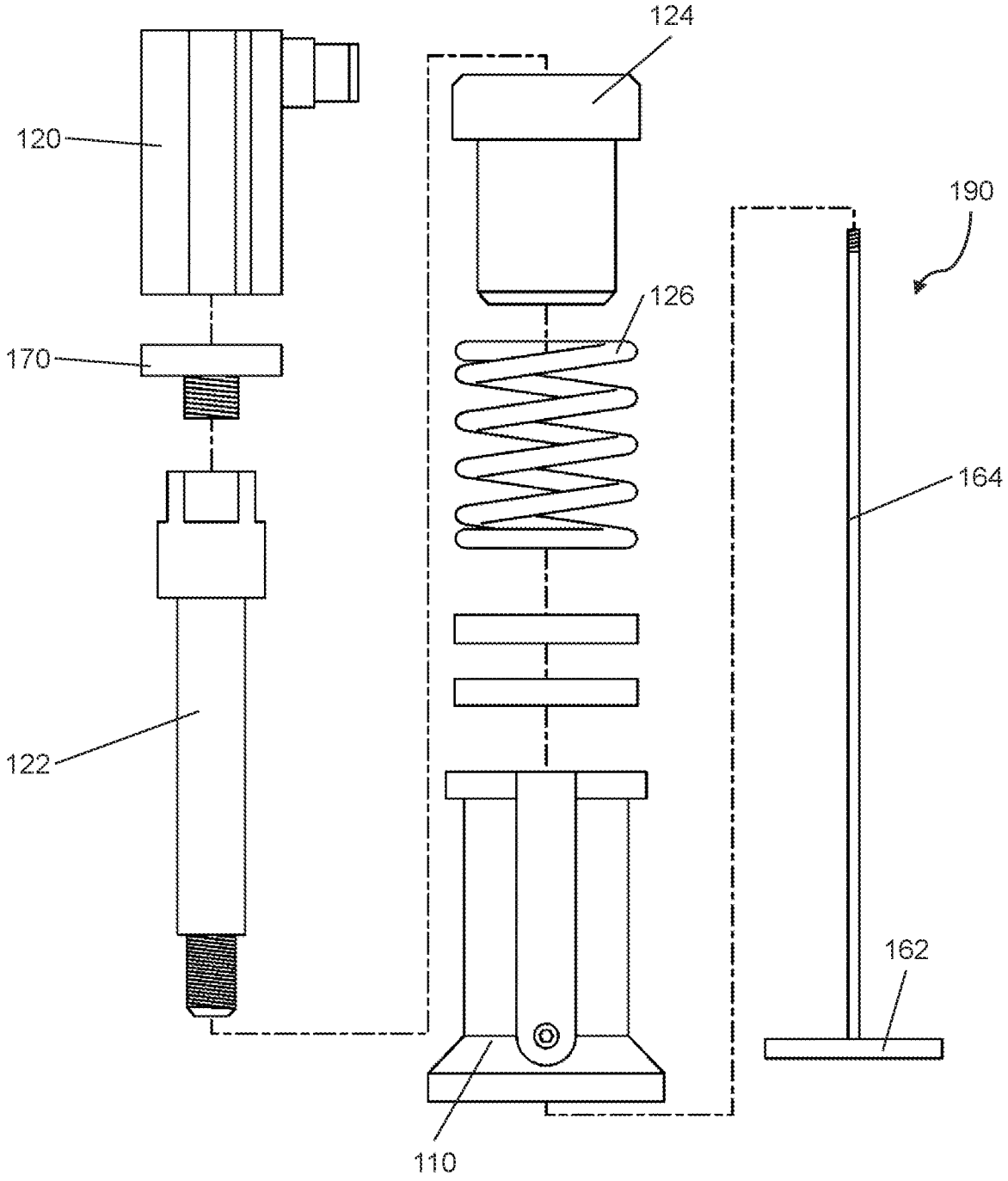
FIG. 5 is an assembly view of the sealing head of FIG. 1.
Figure 6:
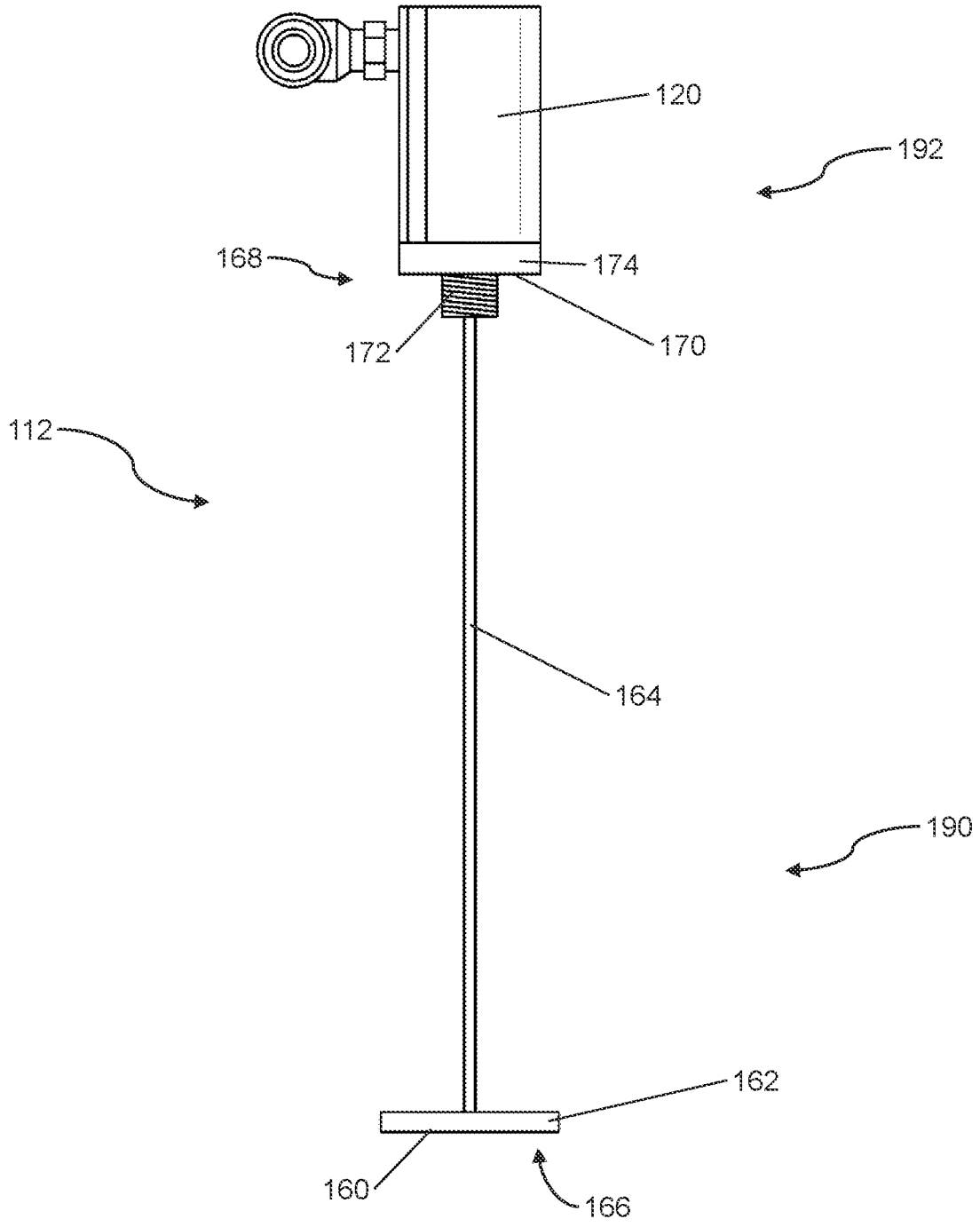
FIG. 6 is a side view of a ram assembly of the sealing head of FIG. 1.
Figure 7:
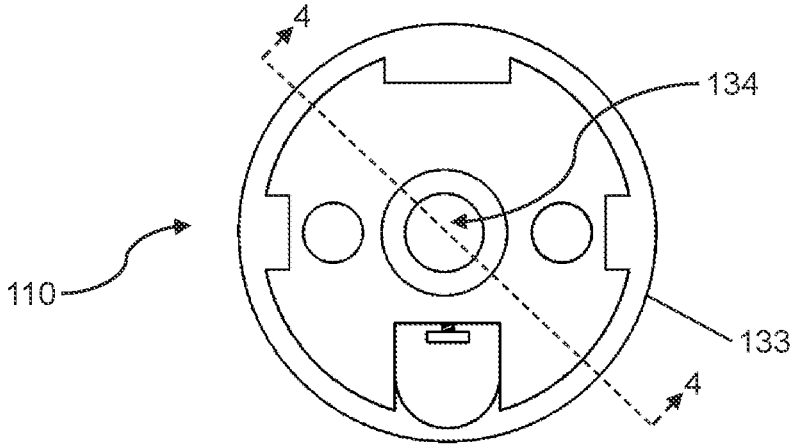
FIG. 7 is a top view of a sealing element of the sealing head of FIG. 1.
Figure 8:
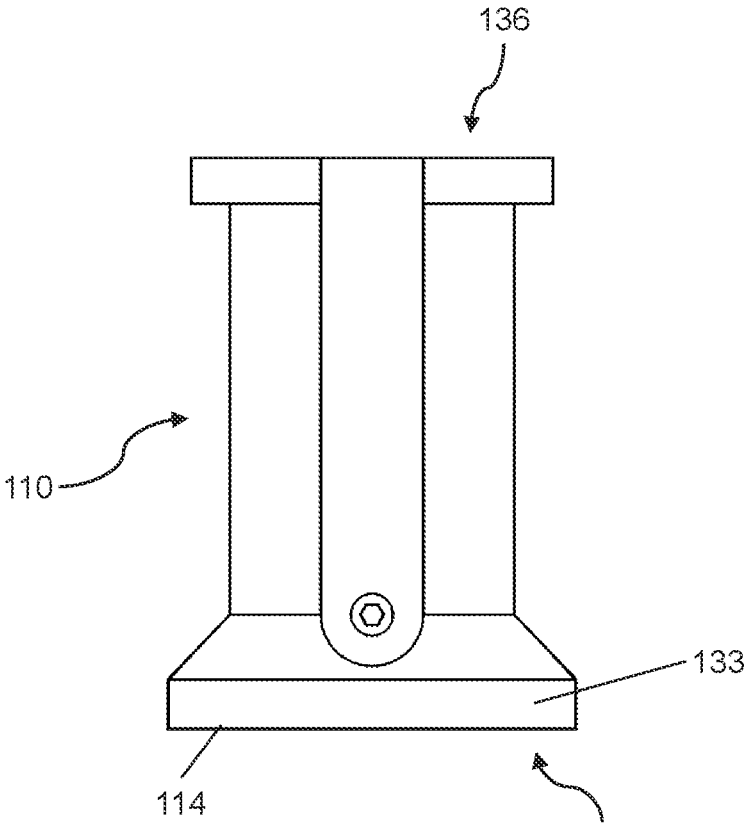
FIG. 8 is a side view of the sealing element FIG. 7.
Figure 10:
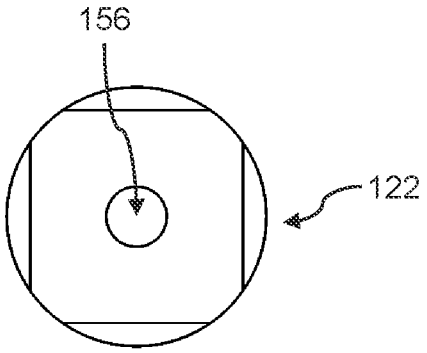
FIG. 10 is a top view of the slide rod of FIG. 9.
Figure 11:
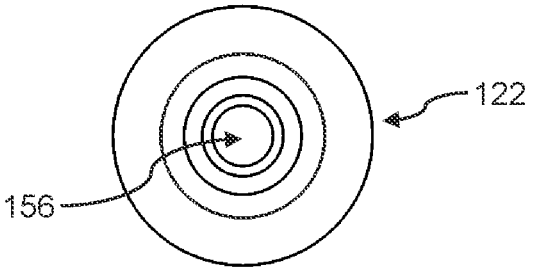
FIG. 11 is a bottom view of the slide rod of FIG. 9.
Figure 9:
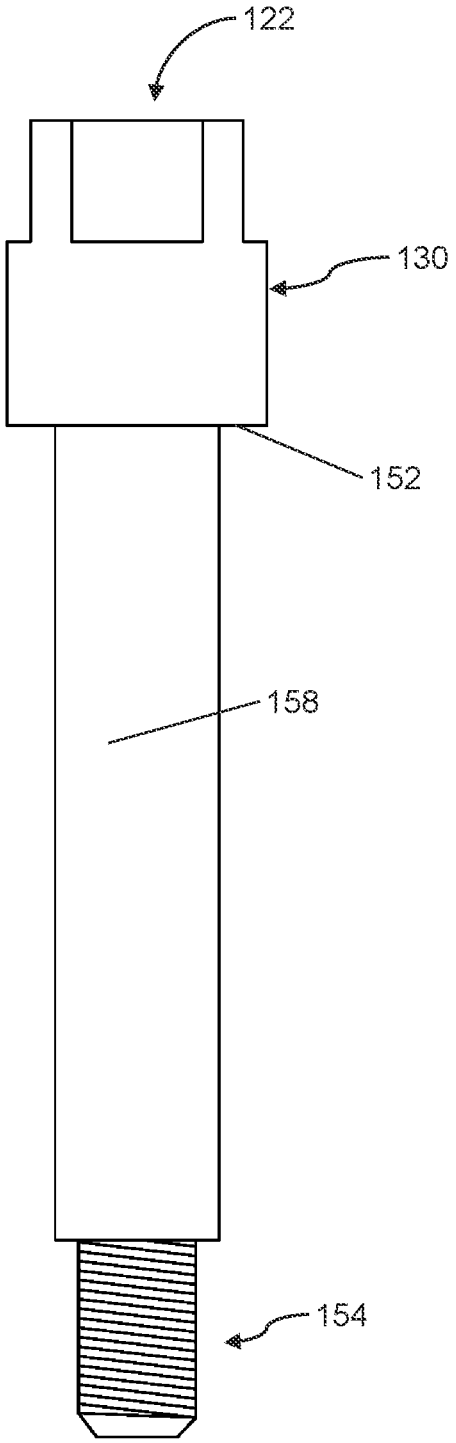
FIG. 9 is a side view of a slide rod of the sealing head of FIG. 1.
Figure 12:
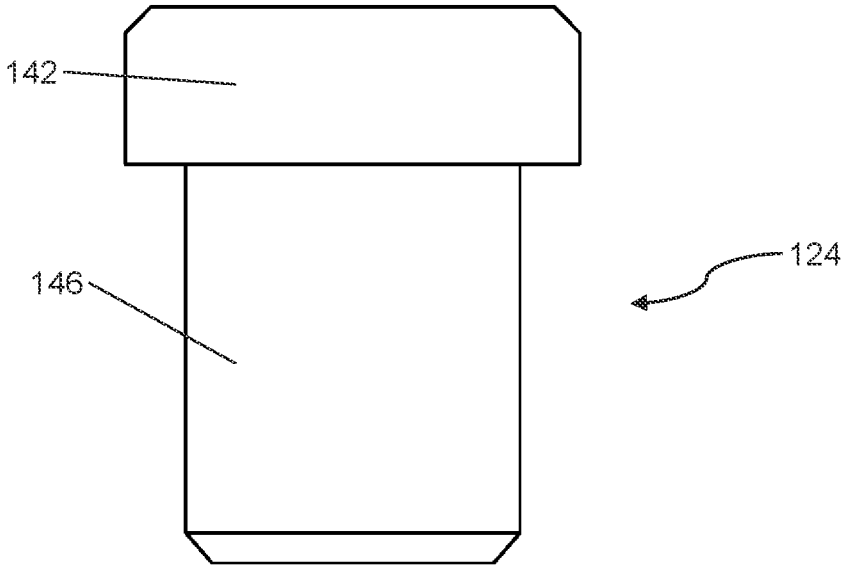
FIG. 12 is a front view of a mounting collar of the sealing head of FIG. 1.
Figure 13:
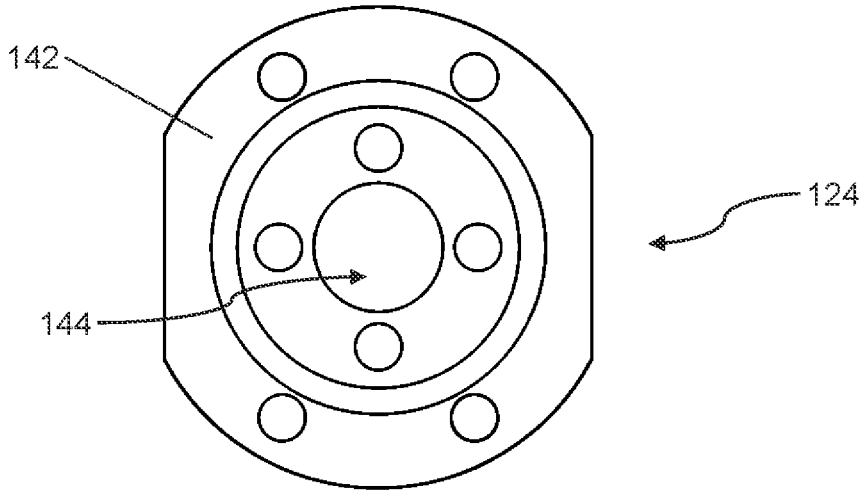
FIG. 13 is a bottom view of the mounting collar of FIG. 12.

The ram assembly 112 comprises a movable portion 190 and a mounting portion 192 (as shown in FIG. 6). The movable portion 190 includes the pressing face 160 and is movable between the retracted position 116 and the extended position 118. The mounting portion 192 couples the movable portion 190 to the sealing assembly 108 (as shown in FIG. 4). When the movable portion 190 is in the retracted position 116, the sealing surface 114 of the sealing assembly 108 can contact the lid 104 to secure the lid 104 to the body 106 of the pod 102 during manufacturing of the pod 102 (as shown in FIG. 14B). After the lid 104 has been secured, the movable portion 190 can be moved from the retracted position 116 to the extended position 118 so that the pressing face 160 contacts the lid 104 and pushes the pod 102 away from the sealing surface 114 to separate the pod 102 from the sealing assembly 108 (as shown in FIG. 14C). In this manner, the ram assembly 112 can help to separate the pod 102 from the sealing assembly 108 during manufacturing of the pod 102.

Figure 2:
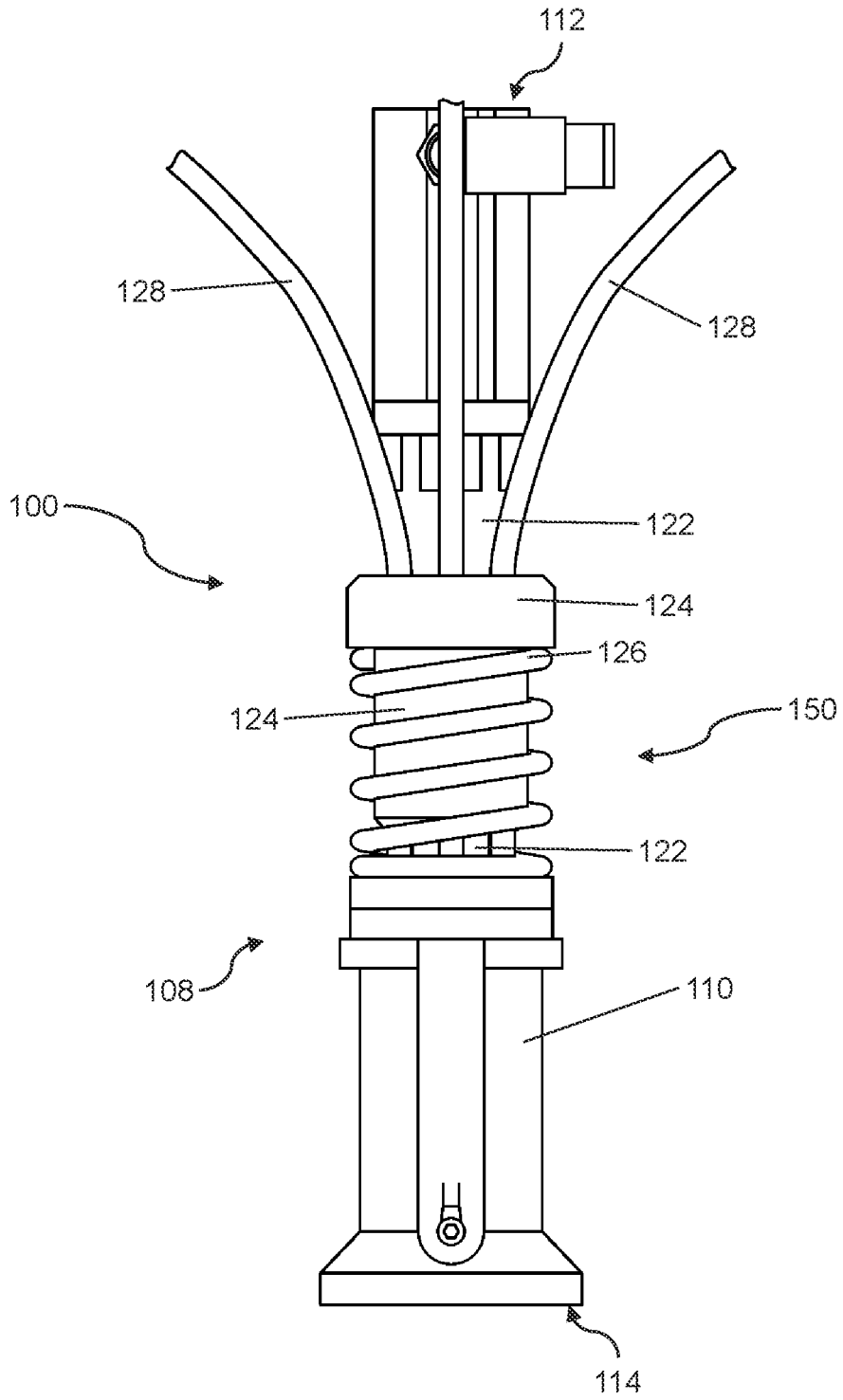
FIG. 2 is a front view of the sealing head of FIG. 1.
Figure 3:
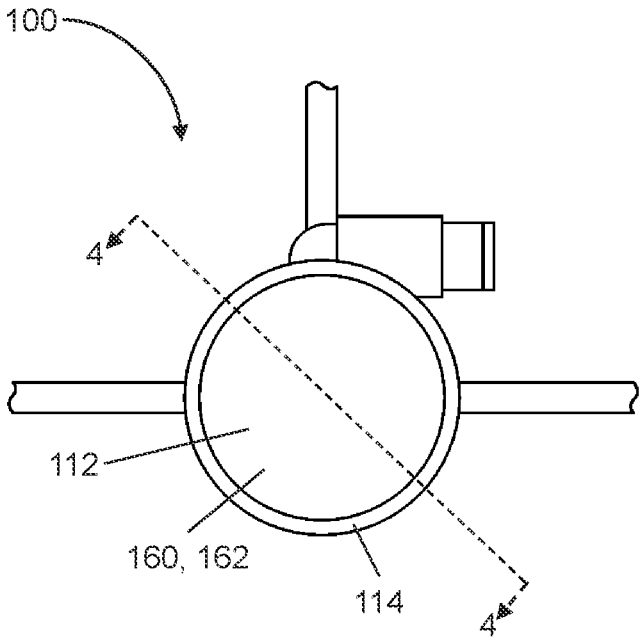
FIG. 3 is a bottom view of the sealing head of FIG. 1.

The sealing assembly 108 comprises a sealing element 110, a slide rod 122, a mounting collar 124, and a damping spring 126. The sealing element 110 defines the sealing surface 114. The slide rod 122 is coupled to and extends from the sealing element 110, opposite the sealing surface 114. The mounting collar 124 is movably retained on the slide rod 122, between the sealing element 110 and a distal end 130 of the slide rod 122, opposite the sealing element 110. The slide rod 122 is slidable within the mounting collar 124 to move the slide rod 122 and the sealing element 110 relative to the mounting collar 124. The damping spring 126 is secured between the mounting collar 124 and the sealing element 110. The damping spring 126 biases the mounting collar 124 away from the sealing element 110. The sealing assembly 108 may also include a plurality of wires 128, such as for heating the sealing element 110 and/or for a thermocouple to sense temperature of the sealing element 110. As will be appreciated, the wires 128 are shown in FIGS. 1 to 3 only, and are omitted from the remaining figures for clarity.

As shown in FIG. 4, the sealing assembly 108 includes an internal passageway 132. The ram assembly 122 extends through the internal passageway 132 of the sealing assembly 108. The internal passageway 132 includes a rod portion 132*a* defined by the slide rod 122 and an element portion 132*b* defined by the sealing element 110. In the retracted position, the ram assembly 122 extends completely through the rod portion 132*a* and extends partially through the element portion 132*b*, such that an end of the ram assembly 122 (e.g., the end with the pressing face 160) terminates in the element portion 132*b*. In the extended position, the ram assembly 122 extends completely through both the rod portion 132 and the element portion 132*b*.

The sealing assembly 108 is configured to secure the lid 104 to the body 106 of the pod 102 during manufacturing. In the subject embodiment, the sealing element 110 is heated and pressed against the lid 104, which in turn presses against the body 106, to thermally fuse the lid 104 to the body 106. The sealing element 110 is heated electrically via the wires 128. In other embodiments, an adhesive may be provided between the lid 104 and the body 106, such that the sealing element 110 merely presses against the lid 104 to secure the lid 104 to the body 106.

The sealing element 110 comprises the sealing surface 114. The sealing surface 114 is located at a sealing end 140 of the sealing element 110. The sealing surface 114 engages the lid 104 during manufacturing of the pod 102. In the subject embodiment, the sealing element 110 comprises a generally cylindrical body 133 that defines the sealing surface 114, and the sealing surface 114 is generally annular (as shown in FIG. 3). As mentioned above, the sealing element 110 defines an element portion 132*b* of the internal passageway 132. The element portion 132*b* of the internal passageway 132 extends from the sealing end 140 of the sealing element 110 to a distal end 136 of the sealing element 110, opposite the sealing end 140.

The sealing element 110 includes a central hole 134, which extends axially through the sealing element 110 from the sealing end 140 to the distal end 136. The central hole 134 defines the element portion 132*b* of the internal passageway 132. At the distal end 136 of the sealing element 110, the central hole 134 is threaded to securely receive the slide rod 122 therein. At the sealing end 140 of the sealing element 110, the central hole 132 includes an enlarged recess 138. The recess 138 is sized to receive at least a portion of the ram assembly 112. In the subject embodiment, the recess 138 is sized to receive a ram head 162 of the ram assembly 112. When the movable portion 190 of the ram assembly 112 is in the retracted position 116, the ram head 162 is positioned within the recess 138. In the subject embodiment, the sealing surface 114 surrounds the recess 138. In the subject embodiment, the sealing surface 114 encircles the ram head 162, when the ram assembly 112 is in the retracted position 116 (as shown in FIG. 3). Accordingly, the pressing face 160 is circumferentially surrounded by the sealing assembly 108 when the movable portion 190 of the ram assembly 112 is in the retracted position 116 (i.e., when the pressing face 160 is aligned with or recessed from the sealing surface 114).

The mounting collar 124 is configured to secure the sealing head 100 to a pod manufacturing machine, as is well known in the art. For example, the mounting collar 124 can be fixedly coupled to an armature of the pod manufacturing machine, or other movable element of the machine, which is configured to advance the sealing head 100 to press the sealing element 110 against the lid 104 during manufacturing of the pod 102. The sealing element 110 and the slide rod 122 are slidably movable with respect to the mounting collar 124, such that impact of the sealing element 110 with the lid 104 of the pod 102 during manufacturing can be at least partially cushioned by the damping spring 126.

The mounting collar 124 comprises a squat, generally cylindrical body 146. The body 146 of the mounting collar 124 includes an enlarged distal end 142. The damping spring 126 is secured between the enlarged distal end 142 of the mounting collar 124 and the sealing element 110. The mounting collar 124 includes an axial hole 144. The slide rod 122 extends through the axial hole 144, such that the mounting collar 124 and the slide rod 122 are slidable with respect to each other between a compressed configuration (not shown) and an extended configuration 150 of the sealing assembly 108 (shown in FIGS. 1, 2 and 4). In the compressed configuration, the damping spring 126 is compressed, and the mounting collar 124 is spaced apart from a distal end 130 of the slide rod 122. In the extended configuration 150, the damping spring 126 is expanded, and the mounting collar 124 is positioned adjacent the distal end 130 of the slide rod 122. As will be appreciated, the compressed configuration can occur when the sealing head 100 is advanced to contact the lid 104 during manufacturing of the pod 102 and the damping spring 126 cushions the impact of the sealing element 110 with the lid 104. On the other hand, the extended configuration 150 can occur when the sealing head 100 is retreated during manufacturing of the pod 102.

The slide rod 122 is configured to slide within the mounting collar 124. The slide rod 122 slides within the mounting collar 124 as the sealing head 100 transitions between the compressed configuration and the extended configuration 150. During this transition, a portion of the sealing head 100 slidably moves with respect to the mounting collar 124. This slidable portion includes the slide rod 122 and the elements of the sealing head 100 that are secured to the slide rod 122 (such as the sealing element 110 and at least the mounting portion 192 of the ram assembly 112). In the subject embodiment, the slidable portion of the sealing head 100 includes the slide rod 122, the sealing element 110, and the entire ram assembly 112. As will be appreciated, the damping spring 126 is mechanically coupled between the slidable portion of the sealing head 100 and the mounting collar 124, to bias the sealing head 100 toward the extended configuration 150.

The slide rod 122 comprises an elongate, generally cylindrical body 158. The slide rod 122 includes a root end 154 and the distal end 130, opposite the root end 154. The root end 154 of the slide rod 122 is threaded. The root end 154 is threadably received within the distal end 136 of the hole 134 of the sealing element 110 (as shown in FIG. 4). The distal end 130 of the slide rod 122 includes a stop 152. The stop 152 engages the mounting collar 124 to arrest movement of the mounting collar 124 in an axial direction. The stop 152 engages the mounting collar 124 when the sealing head 100 is in the extended configuration 150. The stop 152 of the slide rod 122 and the distal end 136 of the sealing element 110 cooperate to retain the mounting collar 124 on the slide rod 122. The slide rod 122 at least partially defines the internal passageway 132 in the sealing head 100. The slide rod 122 includes a central opening 156 that extends from the root end 154 to the distal end 130 of the slide rod 122. The central opening 156 defines the rod portion 132*b* of the internal passageway 132 in the sealing assembly 108. The ram assembly 112 extends through the central opening 156 of the slide rod 122, as shown in FIG. 4.

The damping spring 126 is configured to cushion the impact of the sealing head 100 with the lid 104 of the pod 102 during manufacturing. The damping spring 126 is secured between the mounting collar 124 and the sealing element 110. In the subject embodiment, the damping spring 126 abuts the enlarged distal end 142 of the mounting collar 124, at one end of the damping spring 126, and abuts the sealing element 110, at the opposite end of the damping spring 126. The damping spring 126 biases the mounting collar 124 away from the sealing element 110. Accordingly, the damping spring 126 biases the sealing head 100 toward the extended configuration 150. The damping spring 126 comprises a helical spring, which encircles a portion of the mounting collar 124 and the slide rod 122.

Turning now to FIG. 6, the ram assembly 112 is configured to separate the pod 102 from the sealing assembly 108. Separating the pod 102 from the sealing assembly 108 may be required in instances where the pod 102 sticks to the sealing surface 114 of the sealing assembly 108, such as when applying the lid 104 to the pod 102 during manufacturing. To separate the pod 102 from the sealing assembly 108, the ram assembly 112 is at least partially movable relative to the sealing surface 114. More particularly, the ram assembly 112 includes a movable portion 190, which is movable relative to the sealing surface 114, and a mounting portion 192, which couples the movable portion 190 to the sealing assembly 108. The movable portion 190 includes a pressing face 160. As shown in at least FIG. 14A, in the retracted position 116, the pressing face 160 is recessed from the sealing surface 114, such that the ram assembly 112 does not interfere with the sealing element 110 securing the lid 104 to the body 106 of the pod 102. As shown in FIG. 14C, in the extended position 118, the pressing face 160 extends beyond the sealing surface 114 to contact the pod 102 and push the pod 102 away from the sealing surface 114, thereby separating the pod 102 from the sealing element 108.

As shown in FIGS. 1 and 3, the pressing face 160 is circumferentially surrounded by the sealing assembly 108, when the movable portion 190 of the ram assembly 112 is in the retracted position 116 (i.e., when the pressing face 160 is aligned with or recessed from the sealing surface 114). Accordingly, the sealing surface 114 surrounds the pressing face 160 when viewed from a sealing end 140 of the sealing assembly 110 (as shown in FIG. 3). Although the pressing face 160 is shown in FIGS. 4, 14A, 14B and 14C as being recessed from the sealing surface 114 in the retracted position 116, it will be appreciated that in other embodiments the pressing face 160 may be aligned with the sealing surface 114 in the retracted position 116.

The movable portion 190 of the ram assembly 112 comprises a ram head 162 and a ram rod 164. The ram head 162 is located at a pressing end 166 of the movable portion 190. The ram rod 164 is secured to the ram head 162 and extends away from the ram head 162, opposite the pressing face 160. The ram rod 164 extends from the ram head 162 to an actuation end 168 of the movable portion 190 of the ram assembly 112, opposite the pressing end 166. The ram rod 164 is coupled to an actuator 120 at the actuation end 168. As describe in greater detail below, the actuator 120 pushes and pulls on the ram rod 164 to move the movable portion 190 of the ram assembly 112 between the retracted position 116 and the extended position 118.

The ram head 162 is configured to contact the lid 104 of the pod 102, to push the pod 102 away from the sealing assembly 108. Accordingly, the ram head 162 includes the pressing face 160. In the subject embodiment, the ram head 162 comprises a generally disk-shaped body, which defines the pressing face 160. The ram head 162 is sized to fit within the recess 138 of the sealing element 110. In the subject embodiment, the diameter of the ram head 162 is less than that of the recess 138. As shown in FIG. 4, the ram head 162 is positioned within the internal passageway 132 of the sealing assembly 108, when the movable portion 190 of the ram assembly 112 is in the retracted position 116. More particularly, the ram head 162 is positioned within the recess 138 at the end of the internal passageway 132. The ram head 162 extends at least partially out of the internal passageway 132 when the movable portion 190 is in the extended position 118. In the subject embodiment and as show in FIG. 14C, the ram head 162 extends completely out of the recess 138, and thus completely out of the internal passageway 132, in the extended position. Recessing the ram head 162 within the internal passageway 132 of the sealing assembly 108 can allow the ram head 162 to avoid contact with the lid 104 when the sealing element 110 is securing the lid 104 to the body 106 of the pod 102 during manufacturing, thereby avoiding interference between the lid 104 and the ram assembly 112 while the lid 104 is being secured. In the subject embodiment, the ram head 162 is formed of resilient, non-stick, high temperature plastic. However, in other embodiments the ram head 162 may be formed of the same material as the ram rod 162, or other suitable materials.

The ram rod 164 is configured to connect the ram head 162 to the mounting portion 192 of the ram assembly 112. In the subject embodiment, the ram rod 164 connects the ram head 162 to the actuator 120 of the mounting portion 192. The ram rod 164 extends through the internal passageway 132 in the sealing assembly 108. That is, in the subject embodiment, the ram rod 164 extends through the central hole 134 of the sealing element 110 and through the central opening 156 of the slide rod 122. The ram rod 164 further extends through the hole in the mounting plate 170, described below. The ram rod 164 is threadably secured to the ram head 162, in the subject embodiment. In other embodiments, the ram rod 164 may be integrally formed with the ram head 162. The ram rod 164 extends from the ram head 162, opposite the pressing face 160. The ram rod 164 is secured to the ram head 162 at a first end, which is near the sealing surface 114, and is secured to the actuator 120 at an opposite second end, which is distal from the sealing surface 114. The ram rod 164 comprises a generally narrow cylindrical shaft. The ram rod 164 is threaded at each end to secure the ram rod 164 to the ram head 162 and to the actuator 120. The ram rod 164 is formed of metal or other suitable materials.

The mounting portion 192 of the ram assembly 112 comprises an actuator 120 and a mounting plate 170. The mounting portion 192 couples the ram assembly 112 to the sealing assembly 108 at an end of the sealing assembly 108 that is opposite the sealing surface 114. In the subject embodiment, the mounting portion 192 couples the movable portion 190 of the ram assembly 112 to the slide rod 122 at a distal end 130 of the slide rod 122, which is opposite the sealing element 110.

The actuator 120 is configured to selectively move the movable portion 190 of the ram assembly 112 between the retracted position 116 and the extended position 118. The actuator 120 is coupled to the movable portion 190. More particularly, the actuator 120 is coupled to the ram rod 164 of the movable portion 190, at an opposite end of the ram rod 164 from the ram head 162. In the subject embodiment, the movable portion 190 is biased toward the retracted position 116 and is selectively movable from the retracted position 116 to the extended position 118 by engaging the actuator.

In the subject embodiment, the actuator 120 is pneumatically powered. Accordingly, the actuator 120 can be selectively engaged using compressed air provided from a pod manufacturing machine to which the sealing head 100 is coupled. This allows the actuator 120 of the subject embodiment to be powered without the need for additional equipment, which can simply the use of the sealing head 100 and may reduce costs. In other embodiments, the actuator 120 can be electrically, hydraulically, and/or mechanically powered.

The actuator 120 includes an internal spring that biases the movable portion 190 of the ram assembly 112 toward the retracted position 116. When compressed air is applied to the actuator 120, the actuator 120 moves the ram assembly 112 from the retracted position 116 to the extended position 118. When the compressed air is stopped, the internal spring causes the actuator 120 to move the ram assembly 112 from the extended position 118 back to the retracted position 116. Accordingly, compressed air can be selectively applied to the actuator 120 to selectively move the ram assembly 112 between the retracted position 116 and the extended position 118, such as during use of the sealing head 100 when manufacturing the pod 102. In other embodiments, the spring biasing the movable portion 190 toward the retracted position 116 may be external to the actuator 120. In yet further embodiments, the spring may be omitted and the actuator 120 can be further selectively engageable to move the movable portion 190 of the ram assembly 112 from extended position 118 to the retracted position 116.

The mounting plate 170 secures the ram assembly 112 to the sealing assembly 108. In the subject embodiment, the mounting plate 170 secures the actuator 120 to the sealing assembly 108. More particularly, the mounting plate 170 secures the actuator 120 to the slide rod 122 of the sealing assembly 108. The mounting plate 170 has a hole, through which the ram rod 164 extends. The mounting plate 170 comprises a threaded extension 172, which is secured to the distal end 130 of the slide rod 122. The mounting plate 170 further comprises a body portion 174, which is secured to the actuator 120 by fasteners or other suitable mechanisms.

Turning now to FIGS. 14A to 14D, which show a method for using the sealing head 100 described above. As will be appreciated, these figures show a fragmentary, cross-sectional view taken along an axial direction of the sealing head 100. This cross-sectional view extends through the sealing head 100, the pod 102, and the pod manufacturing machine 180. As will be further appreciated, these figures only show a portion of the sealing head 100 and the pod manufacturing machine 180, for brevity and to simplify understanding of the method. The pod manufacturing machine 180 can include additional elements, such as for moving the pod 102 though the manufacturing process and for moving a sealing head. Such additional elements are well known in the art.

During use of the sealing head 100, the sealing surface 114 of the sealing assembly 108 is pressed against the lid 104 of the pod 102 to secure the lid 104 to the body of the pod 102 (as shown in FIG. 14B). The lid 104 can be secured to the body 106 of the pod 102 by pressure and heat, applied by the sealing element 110. Once the lid 104 is secured to the pod 102, the movable portion 190 of the ram assembly 112 is extended relative to the sealing surface 114 from the retracted position 116 to the extended position 118 (as shown in FIG. 14C). As mentioned above, in the retracted position 118 the pressing face 160 of the ram assembly 112 is aligned with or recess from the sealing surface 114 (as shown in FIG. 14B), and in the extended position 118 the pressing face 160 extends beyond the sealing surface (as shown in FIG. 14C).

Figure 14D:
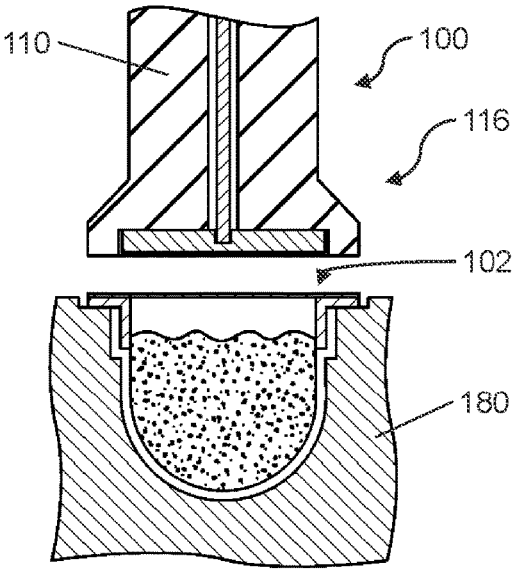

As the pressing face 160 extends beyond the sealing surface 114, the pressing face 160 contacts the lid 104 of the pod 102 to push the pod 102 away from the sealing surface 114 and separate the pod 102 from the sealing assembly 108. Thereafter, the movable portion 190 of the ram assembly 112 can be retracted from the extended position 118 to the retracted position 116 (as shown in FIG. 14D). Retracting the movable portion 190 can prepare the sealing head 100 for securing a subsequent lid to a subsequent pod, to facilitate ongoing manufacturing of multiple single-use pods.

Pressing the sealing surface 114 against the lid 104 of the pod 102 can be accomplished by advancing the sealing element 110 of the sealing assembly 108 toward the lid 104 of the pod 102, such as by using an armature of the pod manufacturing machine 180. Pod manufacturing machines 180 with armatures for advancing a sealing head are well known in the art and will not be described herein for brevity.

The movable portion 190 of the ram assembly 112 can be moved relative to the sealing surface 114 by at least one of extending the movable portion 190 of the ram assembly 112 from the mounting portion 192 of the ram assembly 112, and/or by retreating the sealing element 110 with respect to the pressing face 160 of the ram assembly 112, such that the pressing face 160 extends beyond the sealing surface 114 as the sealing element 110 is retreated.

Extending the movable portion 190 of the ram assembly 112 from the mounting portion 192 can comprise selectively engaging the actuator 120 to extend the movable portion 190. As mentioned above, the actuator 120 can be engaged pneumatically using compressed air from the pod manufacturing machine 180.

Retracting the sealing element 110 with respect to the pressing face 160 comprises the reverse of advancing the sealing element 110. Accordingly, the sealing element can be retracted using the armature of the pod manufacturing machine or other suitable mechanism. Retracting the sealing element 110 can cause the pressing face 160 to extend beyond the sealing surface 114 in embodiments where ram assembly 112 is held stationary as the sealing element 110 is retracted.

Since the above method of using the sealing head 100 does not require a vacuum to be applied to the pod 102, this method may help reduce concavity of the lid 104. Additionally, the ram assembly 112 can help distribute force across the lid 104 when separating the pod 102 from the sealing head 100, which may further reduce concavity of the lid 104.

Although exemplary embodiments have been described above and are shown in the accompanying drawings, it will be appreciated by a person of ordinary skill in the art that variations and modifications may be made without departing from the scope as defined by the appended claims, and the scope of the claims should be given the broadest interpretation consistent with the specification as a whole.

What is claimed is:

1. A sealing head for use in manufacturing a single-use pod, the sealing head comprising:

a sealing assembly for securing a lid to a body of the pod, the sealing assembly having a sealing surface for pressing against the lid; and a ram assembly for separating the pod from the sealing assembly, the ram assembly being at least partially movable relative to the sealing surface between a retracted position and an extended position, wherein in the retracted position a pressing face of the ram assembly is aligned with or recessed from the sealing surface, and in the extended position the pressing face extends beyond the sealing surface to contact the pod and separate the pod from the sealing assembly, and wherein the sealing assembly comprises:

a sealing element that includes the sealing surface;

a slide rod that is coupled to and extends from the sealing element, opposite the sealing surface;

a mounting collar that is movably retained on the slide rod and is configured to secure the sealing head to a pod manufacturing machine, the slide rod being slidable within the mounting collar to move the slide rod and the sealing element relative to the mounting collar; and a damping spring secured between the mounting collar and the sealing element, the damping spring biasing the mounting collar away from the sealing element.

2. The sealing head of claim 1, wherein the ram assembly comprises a movable portion and a mounting portion, wherein the movable portion includes the pressing face and is movable relative to the sealing surface between the retracted position and the extended position, and wherein the mounting portion couples the movable portion to the sealing assembly.

3. The sealing head of claim 2, wherein the movable portion comprises a ram head and a ram rod, wherein the ram head includes the pressing face, and wherein the ram rod extends from the ram head opposite the pressing face and connects the ram head to the mounting portion.

4. The sealing head of claim 3, wherein the ram rod extends through an internal passageway of the sealing assembly.

5. The sealing head of claim 4, wherein the ram head is positioned within the internal passageway when the movable portion is in the retracted position, and wherein the ram head extends at least partially out of the internal passageway when the movable portion is in the extended position.

6. The sealing head of claim 5, wherein the ram head is positioned within an enlarged recess of the internal passageway when the movable portion is in the retracted position.

7. The sealing head of claim 2, wherein the movable portion of the ram assembly is biased toward the retracted position and is selectively movable from the retracted position to the extended position.

8. The sealing head of claim 2, wherein the mounting portion comprises an actuator that is coupled to the movable portion, and wherein the actuator is selectively engageable to move the movable portion from the retracted position to the extended position.

9. The sealing head of claim 8, wherein the actuator is pneumatically powered.

10. The sealing head of claim 8, wherein the mounting portion comprises a mounting plate for securing the actuator to the sealing assembly.

11. The sealing head of claim 1, wherein the slide rod and the sealing element define an internal passageway of the sealing assembly, and wherein the ram assembly extends through the internal passageway.

12. The sealing head of claim 11, wherein the ram assembly is coupled to the slide rod at an end of the slide rod that is opposite the sealing element.

13. The sealing head of claim 1, wherein the pressing face is circumferentially surrounded by the sealing assembly when the pressing face is aligned with or recessed from the sealing surface.

14. The sealing head of claim 1, wherein the sealing surface surrounds the pressing face when viewed from a sealing end of the sealing assembly.

15. A pod manufacturing machine comprising a sealing head as described in claim 1.

16. A sealing head for use in manufacturing a single-use pod, the sealing head comprising:

a sealing assembly for securing a lid to a body of the pod, the sealing assembly having a sealing surface for pressing against the lid; and a ram assembly for separating the pod from the sealing assembly, the ram assembly being at least partially movable relative to the sealing surface between a retracted position and an extended position, wherein in the retracted position a pressing face of the ram assembly is aligned with or recessed from the sealing surface, and in the extended position the pressing face extends beyond the sealing surface to contact the pod and separate the pod from the sealing assembly, wherein the ram assembly comprises a movable portion and a mounting portion, wherein the movable portion includes the pressing face and is movable relative to the sealing surface between the retracted position and the extended position, wherein the mounting portion couples the movable portion to the sealing assembly, wherein the mounting portion comprises an actuator that is coupled to the movable portion, wherein the actuator is selectively engageable to move the movable portion from the retracted position to the extended position, and wherein the actuator is pneumatically powered.

17. A sealing head for use in manufacturing a single-use pod, the sealing head comprising:

a sealing assembly for securing a lid to a body of the pod, the sealing assembly having a sealing surface for pressing against the lid; and a ram assembly for separating the pod from the sealing assembly, the ram assembly being at least partially movable relative to the sealing surface between a retracted position and an extended position, wherein in the retracted position a pressing face of the ram assembly is aligned with or recessed from the sealing surface, and in the extended position the pressing face extends beyond the sealing surface to contact the pod and separate the pod from the sealing assembly, wherein the ram assembly comprises a movable portion and a mounting portion, wherein the movable portion includes the pressing face and is movable relative to the sealing surface between the retracted position and the extended position, wherein the mounting portion couples the movable portion to the sealing assembly, wherein the mounting portion comprises an actuator that is coupled to the movable portion, wherein the actuator is selectively engageable to move the movable portion from the retracted position to the extended position, and wherein the mounting portion comprises a mounting plate for securing the actuator to the sealing assembly.

* * * * *